US006368116B1

(12) United States Patent
Tabata et al.

(10) Patent No.: US 6,368,116 B1
(45) Date of Patent: Apr. 9, 2002

(54) FLEXIBLE BOARD ATTACHING-CONNECTING DEVICE

(75) Inventors: Taichi Tabata, Kanagawa; Kazuhiro Konishi, Shizuoka, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/437,505

(22) Filed: Nov. 10, 1999

(30) Foreign Application Priority Data

Nov. 12, 1998 (JP) ..... 10-322147

(51) Int. Cl.[7] ..... H01R 12/00

(52) U.S. Cl. ..... 439/67; 439/329; 439/77; 439/493

(58) Field of Search ..... 439/66, 67, 77, 439/78, 79, 329, 497, 496, 493, 62, 65

(56) References Cited

U.S. PATENT DOCUMENTS

| | | | | | |
|---|---|---|---|---|---|
| 4,695,258 | A | * | 9/1987 | Hanson et al. | 439/67 |
| 5,219,293 | A | * | 6/1993 | Imamura | 439/67 |
| 5,297,968 | A | * | 3/1994 | Johnson et al. | 439/67 |
| 5,525,064 | A | * | 6/1996 | Mowry | 439/66 |

FOREIGN PATENT DOCUMENTS

| | | |
|---|---|---|
| JP | 7-122315 | 5/1995 |

* cited by examiner

*Primary Examiner*—Tho D. Ta
*Assistant Examiner*—Truc Nguyen
(74) *Attorney, Agent, or Firm*—Pearne & Gordon LLP

(57) ABSTRACT

A flexible board attaching-connecting device includes a case assembly, formed by incorporating a flexible board 2 in a case 1, and a board assembly formed by mounting a flexible board connector 3 on a printed circuit board 4, and an attaching-connecting operation can be made merely by dropping the case assembly onto the board assembly from an upper side.

5 Claims, 6 Drawing Sheets

PRIOR ART

PRIOR ART

FLEXIBLE BOARD ATTACHING-CONNECTING DEVICE

BACKGROUND OF THE INVENTION

This invention relates to a flexible board attaching-connecting device in an electronic equipment such as a portable telephone and a wireless device, and more particularly to a structure in which a case assembly, incorporating a flexible board, is dropped onto a printed circuit board from an upper side, thereby electrically connecting contacts, formed on the flexible board, to vertical, spring-type contacts of a connector mounted on the printed circuit board.

There is known a conventional flexible board attaching-connecting device as shown in FIGS. 5 and 6. As shown in FIG. 5, in the conventional flexible board attaching-connecting device, a flexible board 12 is mounted on a case 11, and a connector portion, extending from the flexible board 12, is bent and inserted into a flexible board connector 13 on a printed circuit board 14 with which the case 11 is mated, and in this manner the connector portion is attached and connected to the connector 13. This will be more specifically described with reference to FIGS. 6A and 6B. FIG. 6A shows a condition immediately before the extended connector portion of the flexible board 12 is attached and connected to the flexible board connector 13 having a lever. FIG. 6B shows a condition in which the extended connector portion of the flexible board 12 is inserted into the flexible board connector 13, having the lever, and is completely attached and connected to this connector 13 by rotating the lever 15. Such a construction is disclosed, for example, in the Unexamined Japanese Patent Application Publication No. Hei 10-126070.

In the above conventional flexible board attaching-connecting device, the connector portion, extending from the flexible board, is bent and inserted into the flexible board connector, and therefore there have been encountered problems that the flexible board need to have an extra length (area) for attaching and connecting purposes, and that the step of bending the flexible board, the step of inserting the connector portion into the flexible board connector and the step of locking the connector portion by the lever are needed.

SUMMARY OF THE INVENTION

This invention has been made in order to solve the above problems, and an object of the invention is to provide a flexible board attaching-connecting device in which a case assembly is dropped onto a board assembly from an upper side to thereby attach and connect a flexible board to a printed circuit board, thus providing the flexible board attaching-connecting device which is inexpensive, and has a good assembling efficiency and a high connection reliability.

According to the present invention, there is provided a flexible board attaching-connecting device CHARACTERIZED by the provision of a case assembly formed by incorporating a flexible board in a case; a board assembly formed by mounting a flexible board connector on a printed circuit board; and attaching-connecting means by which an attaching-connecting operation can be completed merely by dropping the case assembly onto the board assembly from an upper side.

With this construction, there can be provided the flexible board attaching-connecting device in which the efficiency of the assembling operation is enhanced, and the reliability is enhanced, and the cost can be reduced.

The invention of aspect 1 is directed to a flexible board attaching-connecting device CHARACTERIZED by the provision of a case assembly formed by incorporating a flexible board in a case; a board assembly formed by mounting a flexible board connector on a printed circuit board; and attaching-connecting means by which an attaching-connecting operation can be completed merely by dropping the case assembly onto the board assembly from an upper side. Therefore, the flexible board can be brought into contact with the flexible board connector merely by dropping the case assembly from the upper side.

In the flexible board attaching-connecting device of the invention of aspect 2 depending from aspect 1, the flexible board connector includes first positioning bosses, which are adapted to be respectively inserted in and positioned relative to positioning holes in the printed circuit board, and second positioning bosses which are adapted to pass through the flexible board and further to be respectively inserted in and positioned relative to positioning holes in the case. Therefore, the contact member and the member to be contacted are directly positioned, and therefore the connection reliability is enhanced.

In the flexible board attaching-connecting device of the invention of aspect 3 depending from aspect 1 or aspect 2, the flexible board connector includes vertically extending spring-type contacts. Therefore, tolerances in the direction of the thickness (in the upward-downward direction) can be absorbed by the spring-type contacts.

In the flexible board attaching-connecting device of the invention of aspect 4 depending from any one of aspects 1 to 3, a connector portion of the case has a flat portion, and the flexible board is held against the flat portion, thereby preventing the flexible board from being deformed by a reaction force from the spring-type contacts. Therefore, the tolerances in the direction of the thickness (in the upward-downward direction) can be absorbed by the spring-type contacts, and besides the deformation due to the reaction force of the spring-type contacts can be prevented.

DESCRIPTION OF THE PREFERRED EMBODIMENTS

A preferred embodiment of the present invention will now be described with reference to FIGS. 1 to 5.

Figure 1:
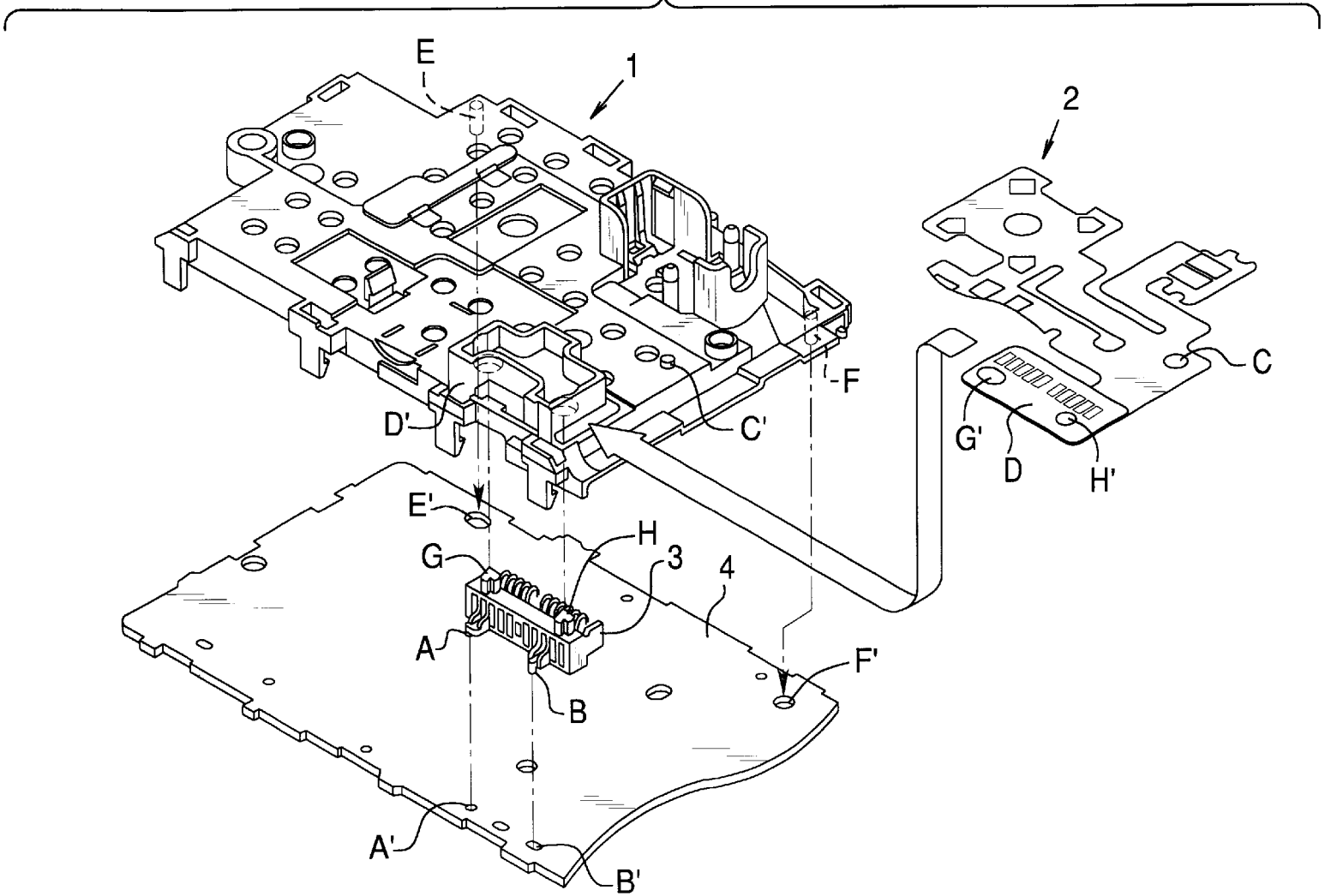
FIG. 1 is an exploded, perspective view showing the construction of a preferred embodiment of a flexible board attaching-connecting device of the present invention.

FIG. 1 is an exploded, perspective view showing the construction of one preferred embodiment of a flexible board attaching-connecting device of the present invention. In FIG. 1, the flexible board attaching-connecting device comprises a case assembly, formed by incorporating a flexible board 2 in a case 1, and a board assembly formed by mounting a flexible board connector 3 on a printed circuit board 4. The attachment-connection can be made merely by dropping the case assembly onto the board assembly from one direction.

In the case assembly, first, a connector portion D of the flexible board 2 is inserted into a corresponding connector portion D' of the case 1, and also a positioning hole C in the flexible board 2 is fitted on a corresponding positioning portion C' of the case 1, and by doing so, the flexible board 2 is provisionally positioned and fixed relative to the case 1. In this condition, the positioning hole C in the flexible board 2 is loosely fitted on the corresponding positioning portion C' of the case 1, and therefore the flexible board 2, placed on the case 1, is movable an amount corresponding to a gap between the two.

In the board assembly, first, positioning pins A and B on the flexible board connector 3 are inserted respectively into positioning holes A' and B' in the printed circuit board 4, thereby positioning and fixing the flexible board connector 3 relative to the printed circuit board 4.

The attachment of the flexible board connector 3 to the printed circuit board 4 will be described in detail. Electronic parts, such as resistors and capacitors, are mounted on the printed circuit board 4 by reflow soldering. In the reflow soldering, cream solder is screen printed onto the printed circuit board, having lands, and predetermined electronic parts are put on respective predetermined portions of the printed cream solder by a mounting machine, and thereafter the printed circuit board is passed through a high-temperature atmosphere (in a reflow furnace), and as a result the cream solder is melted, so that the electronic parts are bonded to the lands.

Similarly, the flexible board 2 is placed on the printed circuit board, and springs, contained therein, are bonded to the lands by reflow soldering. At this time, there is a possibility that the parts are displaced out of position upon application of a blast of hot air within the reflow furnace, and are not properly reflow-soldered, and therefore it is necessary to position the parts relative to the printed circuit board.

Therefore, in this embodiment, the positioning pins A and B are inserted respectively into the positioning holes A' and B', and by doing so, the above displacement is prevented.

With respect to this insertion, in order that the flexible board connector 3 can be suction held by an automatic suction machine, a flat portion is formed on an upper surface, thereby enabling the suction holding, and therefore the flexible board connector 3 can be transferred to and placed on the printed circuit board 4 by the automatic machine.

For mounting the case assembling on the board assembly, positioning pins E and F on the case 1 are inserted respectively into positioning holes E' and F' in the board 4, thereby positioning the case 1 relative to the printed circuit board 4. At the same time, pins G and H on the flexible board connector 3 are inserted directly respectively into holes G' and H' in the connector portion D of the flexible board 2, so that the connector portion D, D' is positioned.

As described above, the flexible board 2 is movably mounted on the case 1, and therefore when mounting the case 1 on the printed circuit board 4, the positions of the positioning pins E and F on the case 1 relative to the holes G' and H' in the connector portion D can be changed within the range of dimensional tolerances since these parts have the dimensional tolerances.

In order that the pins G and H on the connector can positively pass respectively through the connector holes G' and H' when mounting the case 1 on the printed circuit board, the dimensional accuracies of the case 1, printed circuit board 4, flexible board 2 and connector 3 must be made high. This increases the costs of the parts.

Therefore, if the flexible board 2 is slightly movable on the casing 1, it is not necessary to form the parts of high precision, and the costs of the parts can be reduced.

Figure 2:
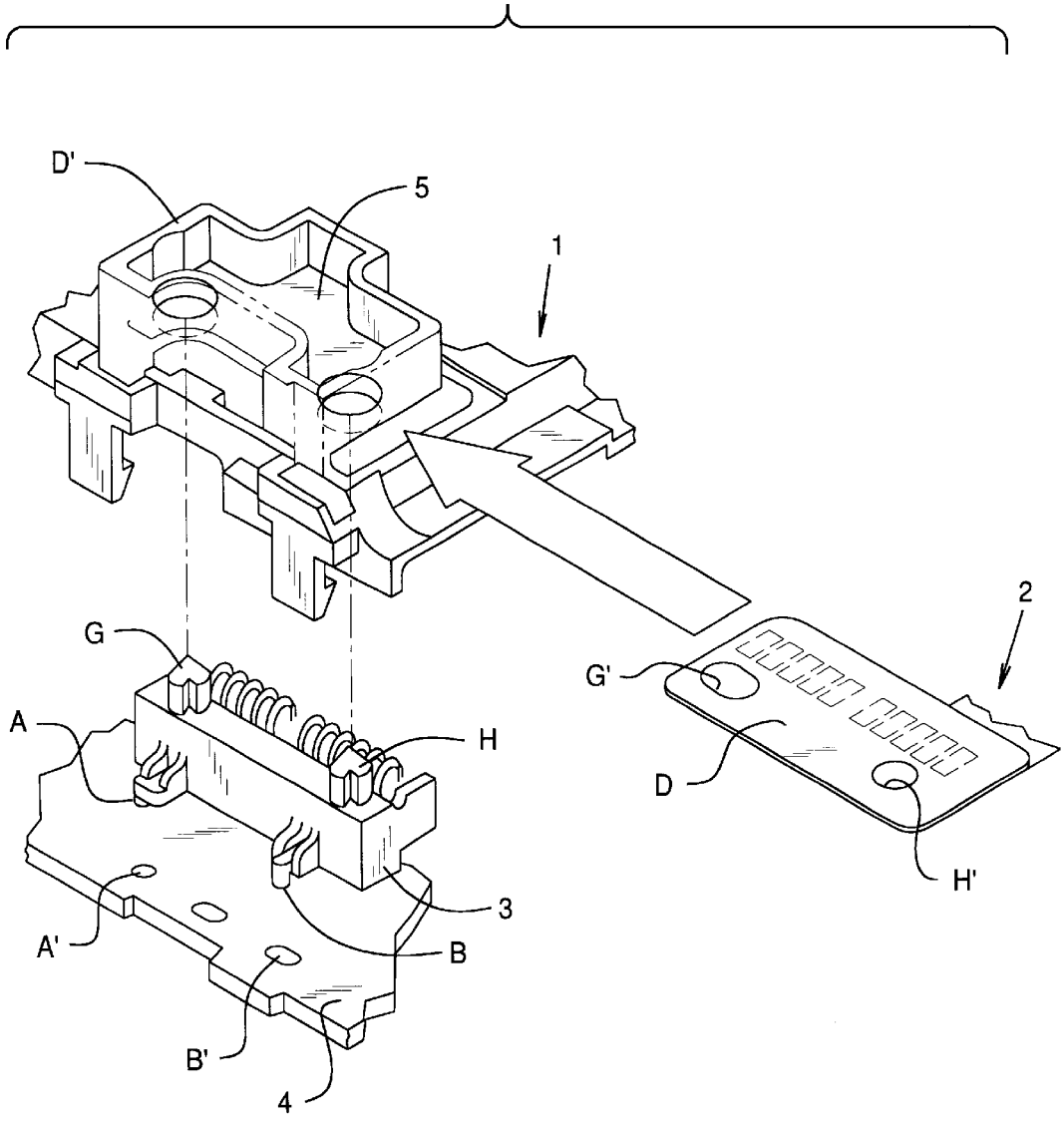
FIG. 2 is an exploded, perspective view showing a portion of the flexible board attaching-connecting device of FIG. 1 on an enlarged scale.

FIG. 2 is an exploded, perspective view showing a portion of the flexible board attaching-connecting device on an enlarged scale. In FIG. 2, the construction of the flexible board connector 3 and the construction of the connector portion D of the case 1 are shown more clearly.

Figure 3:
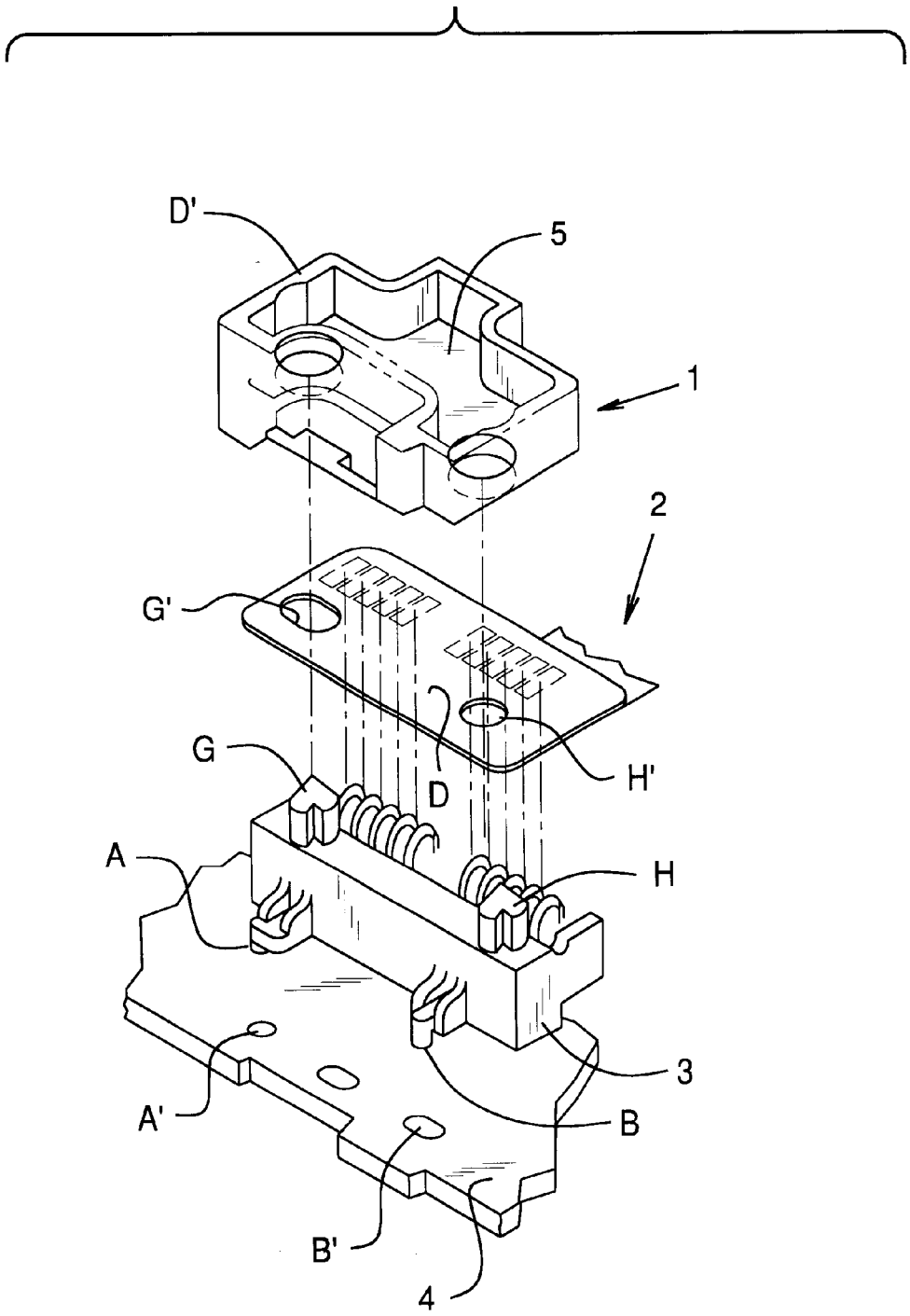
FIG. 3 is a perspective view showing the manner of attaching and connecting the flexible board of FIGS. 1 and 2.

FIG. 3 is a perspective view showing the manner of attaching and connecting the flexible board of FIGS. 1 and 2. In FIG. 3, the holes G' and H' in the connector portion D of the flexible board 2 are directly positioned relative to the positioning pins G and H on the flexible board connector 3, respectively, and at the same time exposed contacts on the connector portion D of the flexible board 2 are contacted respectively with spring-type contacts of the flexible board connector 3 under suitable pressure. Referring to this suitable pressure, the flexible board 2 , when subjected to the pressure, tends to move away from the connector 3, and in this embodiment, there is provided a flat portion 5 facing away from the exposed contacts, and the flexible board 2 is held against this flat portion 5, and therefore the urging force of the springs is always kept stable.

Figure 4:
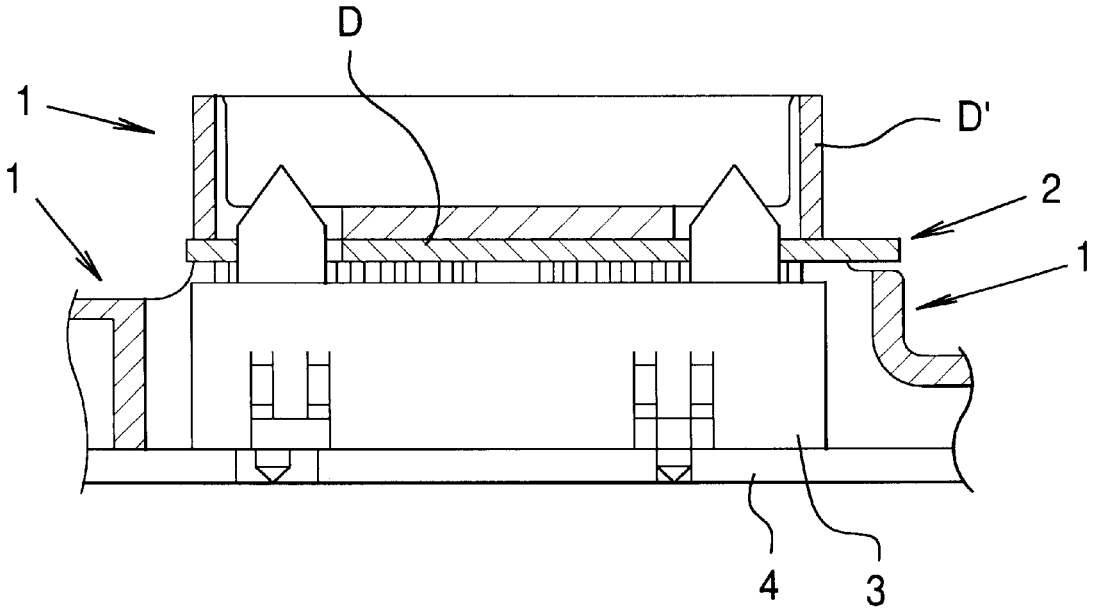
FIG. 4 is a cross-sectional view of a portion of the flexible board attaching-connecting device, showing a condition in which the attaching-connecting operation is finished.
Figure 5:
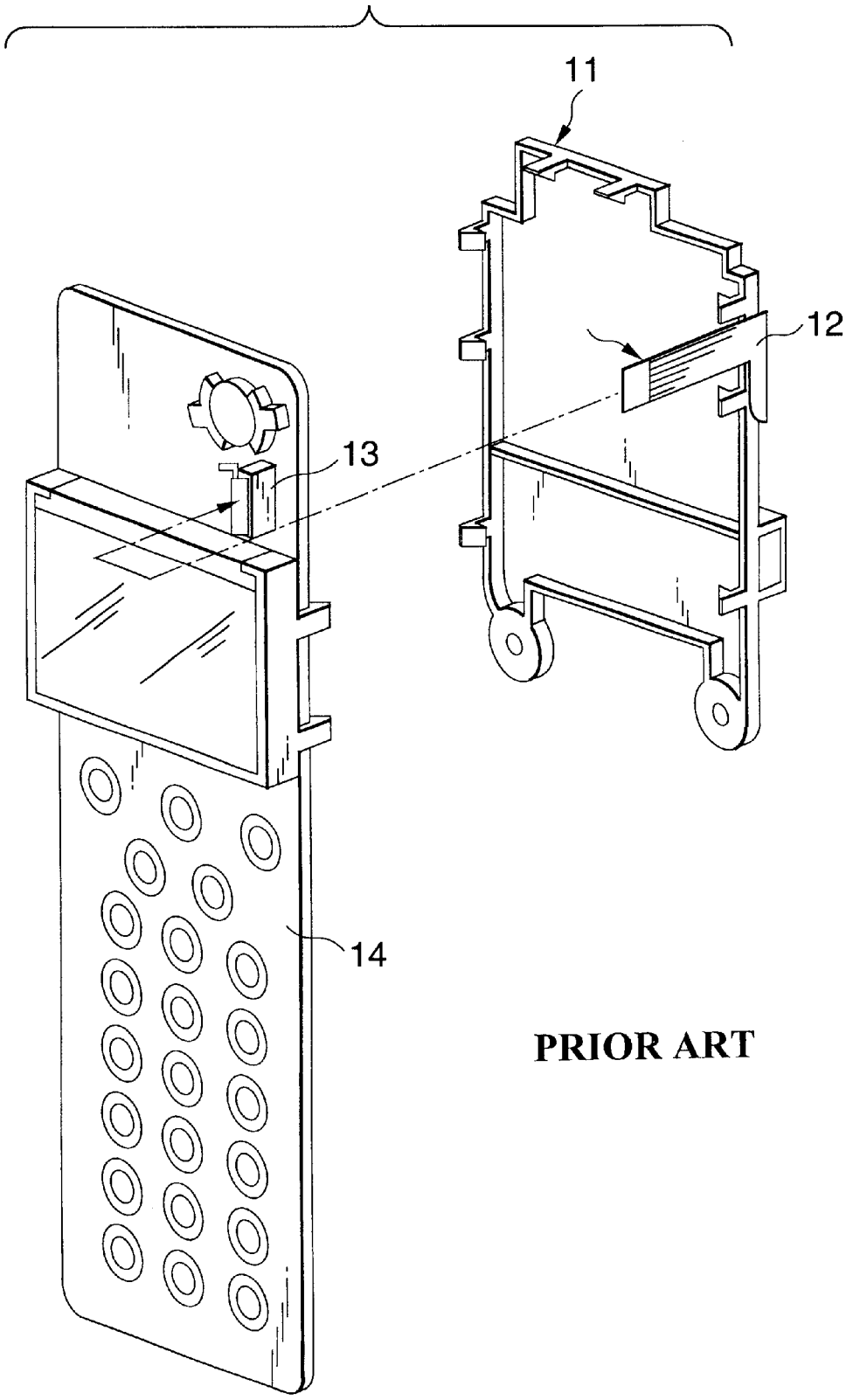
FIG. 5 is a perspective view showing a conventional flexible board attaching-connecting device.
Figure 6A:
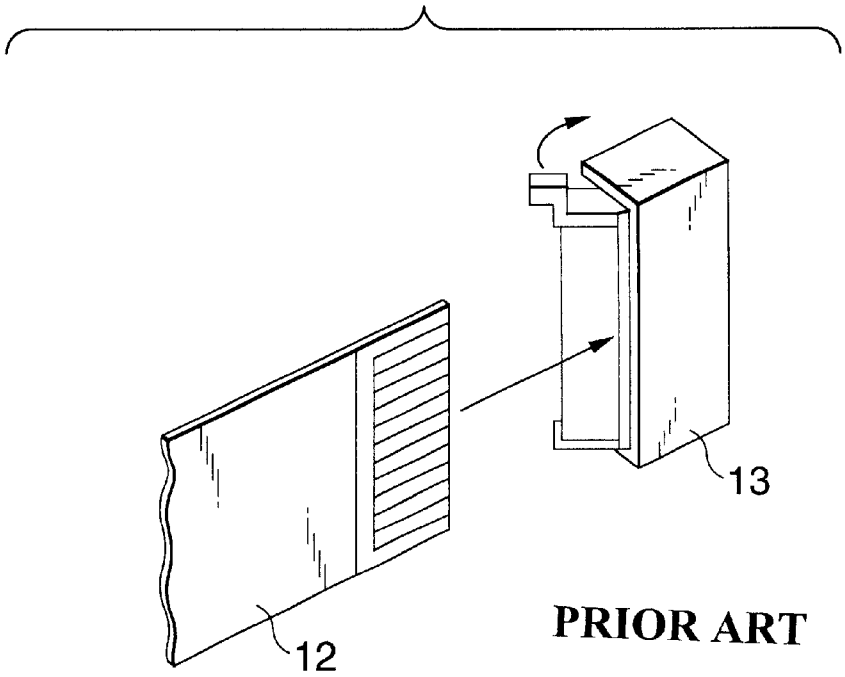
FIGS. 6A and 6B are view showing a connector-connecting operation in the conventional flexible board attaching-connecting device.
Figure 6B:
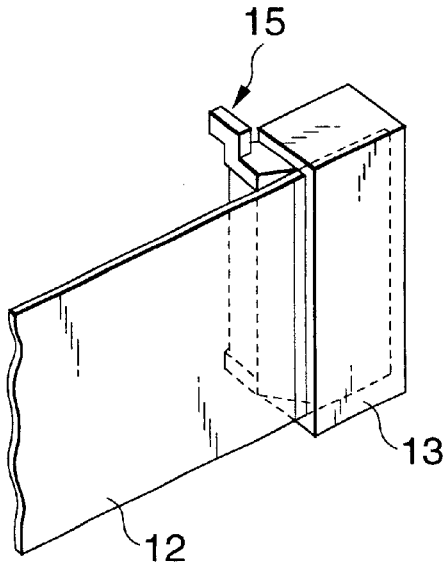
PRIOR ART FIG.6B

FIG. 4 is a cross-sectional view of a portion of the flexible board attaching-connecting device, showing a condition in which the attachment and connection of the case assembly to the board assembly is finished. In FIG. 4, the holes G' and H' in the connector portion D of the flexible board 2 are positioned and fixed relative to the positioning pins G and H of the flexible board connector 3, respectively, and at the same time the exposed contacts on the connector portion D of the flexible board 2 are contacted respectively with the spring-type contacts of the flexible board connector 3 under suitable pressure, and the positioning pins A and B on the flexible board connector 3 are inserted in and positioned and fixed relative to the positioning holes A' and B' in the printed circuit board 4, thereby attaching and connecting the flexible board connector 3 to the printed circuit board 4. As is clear from FIG. 4, a clearance is provided in the positioning hole A' in the printed circuit board 4.

As is clear from the foregoing description, the present invention provides the flexible board attaching-connecting device CHARACTERIZED by the provision of the case assembly formed by incorporating the flexible board in the case, the board assembly formed by mounting the flexible board connector on the printed circuit board, and the attaching-connecting means by which the attaching-connecting operation can be completed merely by dropping the case assembly onto the board assembly from an upper side. With this construction, there can be achieved the flexible board attaching-connecting device in which the efficiency of the assembling operation is enhanced, and the reliability is enhanced, and the cost can be reduced.

What is claimed is:

1. A flexible board attaching-connecting device comprising:

a case assembly comprising a flexible board and a case, said flexible board being mounted above an upper surface of said case, said case integrally including a connector portion that is adapted to receive a connector portion of said flexible board such that said connector portion of said flexible board is accessible from m below said case;

a board assembly comprising a flexible board connector and a printed circuit board, said flexible board connector being mounted to said printed circuit board, said flexible board connector including positioning bosses that extend through openings in a corresponding portion of said flexible board and are inserted into positioning holes in said case; and attaching-connecting means for attaching said case assembly to said board assembly and for electrically connecting said flexible board to said flexible board connector, said attaching and connecting being accomplished by dropping said case assembly onto said board assembly from an upper said such that said connector portion of said flexible board is engaged by said flexible board connector.

2. The flexible board attaching-connecting device according to claim 1, wherein said flexible board connector further includes second positioning bosses that are respectively inserted in and positioned relative to positioning holes in said printed circuit board.

3. The flexible board attaching-connecting device according to claim 1, wherein said flexible board connector includes vertically extending spring-type contacts, said contacts being adapted to engage said corresponding portion of said flexible board.

4. The flexible board attaching-connecting device according to claim 3, wherein said connector portion of said case has a flat portion, and an upper surface of said corresponding portion of said flexible board is held against said flat portion to prevent said flexible board from being deformed by a reaction force from said spring-type contacts.

5. A flexible board attaching-connecting device comprising:

a case assembly comprising a flexible board and a case, said flexible board being mounted to an upper surface of said case, said case integrally including a connector opening in said upper surface and a connector portion having a lower surface facing said connector opening, said flexible board including a connector portion positioned between said connector opening of said case and a lower surface of said connector portion of said case such that said connector portion of said flexible board is accessible through said connector opening from below said case;

a board assembly comprising a flexible board connector and a printed circuit board, said flexible board connector being mounted to said printed circuit board, said flexible board connector including positioning bosses that extend through openings in a corresponding portion of said flexible board and are inserted into positioning holes in said case; and attaching-connecting means for attaching said case assembly to said board assembly and for electrically connecting said flexible board to said flexible board connector, said attaching and connecting being accomplished by dropping said case assembly onto said board assembly from an upper said such that said connector portion of said flexible board is engaged by said flexible board connector.

* * * * *

UNITED STATES PATENT AND TRADEMARK OFFICE

CERTIFICATE OF CORRECTION

PATENT NO. : 6,368,116 B1
DATED : April 9, 2002
INVENTOR(S) : Taichi Tabata and Kazuhiro Konishi It is certified that error appears in the above-identified patent and that said Letters Patent is hereby corrected as shown below:

Column 4,
Line 66, after "from", please delete -- m --.

Signed and Sealed this

Twenty-fourth Day of September, 2002

*Attest:*

*Attesting Officer*

JAMES E. ROGAN
*Director of the United States Patent and Trademark Office*